US010688636B2

(12) United States Patent
Wu

(10) Patent No.: US 10,688,636 B2
(45) Date of Patent: Jun. 23, 2020

(54) DEVICE FOR UNFASTENING PIPE FASTENERS

(71) Applicant: Pi-Liang Wu, Taichung (TW)

(72) Inventor: Pi-Liang Wu, Taichung (TW)

( * ) Notice: Subject to any disclaimer, the term of this patent is extended or adjusted under 35 U.S.C. 154(b) by 327 days.

(21) Appl. No.: 15/644,838

(22) Filed: Jul. 10, 2017

(65) Prior Publication Data

US 2018/0290276 A1 Oct. 11, 2018

(30) Foreign Application Priority Data

Apr. 7, 2017 (TW) ..... 106111824 A

(51) Int. Cl.

| | |
|---|---|
| ***B25B 7/12*** | (2006.01) |
| ***B25B 13/28*** | (2006.01) |
| ***B25B 25/00*** | (2006.01) |
| ***B25B 7/02*** | (2006.01) |
| *B25B 13/44* | (2006.01) |

(52) U.S. Cl.

CPC ..... *B25B 25/005* (2013.01); *B25B 7/02* (2013.01); *B25B 7/12* (2013.01); *B25B 13/28* (2013.01); *B25B 13/44* (2013.01)

(58) Field of Classification Search

CPC B25B 25/005; B25B 7/02; B25B 7/12; B25B 13/28; B25B 13/44; Y10T 29/53657; Y10T 29/5363; Y10T 29/53613

USPC ..... 81/112, 9.3; 294/116

See application file for complete search history.

(56) References Cited

U.S. PATENT DOCUMENTS 2,842,991 A * 7/1958 Lasher ..... F16L 33/023 81/9.3

3,596,686 A 8/1971 Blumenfeld 4,141,262 A * 2/1979 Smith ..... B25B 13/00 81/57.39

4,423,860 A 1/1984 Windstrup 4,619,446 A 10/1986 Yang (Continued)

FOREIGN PATENT DOCUMENTS

TW M253450 12/2004

TW M436346 8/2012

(Continued)

OTHER PUBLICATIONS

In response to the office Action dated Oct. 7, 2019, Transmitted herewith for filing is: Response to Notice of Non-Compliant Amendment, 5.

*Primary Examiner* — Monica S Carter

*Assistant Examiner* — Mahdi H Nejad

(57) ABSTRACT

A device for unfastening fasteners includes an operation device, a cable unit and a working unit. The cable unit is connected between the operation device and the working unit. The operation device includes a first part and a second part pivotably connected to each other by a pivot. The first part includes a first extension with a first hole. The second part includes a second extension with a second hole. A first slot communicates with the first hole. A second slot communicates with the second hole. The cable unit includes a cable and a sheath. The cable extends through the first and second holes via the first and second slots, and connected with an end piece which contacts the first extension. A stop member is mounted to the first extension to close the first slot. The cable is separated from the operation device easily without causing damage to the cable.

4 Claims, 15 Drawing Sheets

(56) References Cited

U.S. PATENT DOCUMENTS 4,823,486 A * 4/1989 Diekevers ..... E02F 9/2841 37/456
6,189,190 B1 * 2/2001 Gillet ..... B25B 7/12 29/229
6,276,236 B1 * 8/2001 Wu ..... B25B 7/12 81/347
6,370,985 B1 * 4/2002 Wu ..... B25B 25/005 29/229
6,736,031 B1 * 5/2004 Kang ..... B25B 7/12 81/322
6,775,891 B1 * 8/2004 Tsiguloff ..... B25B 27/28 29/235
7,104,162 B1 * 9/2006 Wu ..... B25B 7/12 81/3.07
7,313,984 B1 * 1/2008 Eggert ..... B25B 25/005 29/225
9,163,657 B2 * 10/2015 Gillet ..... F16C 1/12
9,939,008 B2 * 4/2018 DesJarlais ..... F16C 1/12
2002/0178869 A1 * 12/2002 Pool ..... B25B 7/12 81/9.3
2004/0011161 A1 * 1/2004 Gmeilbauer ..... B25B 25/005 81/9.3
2013/0026771 A1 * 1/2013 Nazzari ..... G09F 3/0352 292/317
2013/0319165 A1 * 12/2013 Gillet ..... F16C 1/12 74/501.6
2018/0236643 A1 * 8/2018 Wu ..... B25B 7/12
2019/0076993 A1 * 3/2019 Buchanan ..... B25G 1/005
2019/0184531 A1 * 6/2019 Wang ..... B25B 25/005

FOREIGN PATENT DOCUMENTS

TW 201309932 A1 3/2013
TW M484495 8/2014
TW M517625 2/2016

* cited by examiner

DEVICE FOR UNFASTENING PIPE FASTENERS

BACKGROUND OF THE INVENTION

1. Fields of the Invention

The present invention relates to a hand tool, and more particularly to a hand tool for unfastening pipe fasteners in a narrow space such as in an engine room, and more particularly.

2. Descriptions of Related Art

There are many pipes or hoses used in a vehicle for transportation of fluid such as engine oil, fuel, water and the like. The pipes are connected to connectors extending from parts, and fasteners are used to fasten the pipes to the connectors. The fasteners ensure the connection between the pipes and the connectors so that the pipes do not separate from the connectors due to shaking or vibration.

When separating the pipes from the connectors, the fasteners are first enlarged and moved along the pipes until that the fasteners are moved away from the connectors. The pipes are then pulled away from the connectors. When connecting the pipes to the connectors, the pipes are first mounted to the connectors, and the fasteners on the pipes are then enlarged and moved along the pipes until that the fasteners are moved to the connectors. The fasteners are fastened to secure the pipes to the connectors.

Generally, the users use pliers to access the fasteners and enlarge the fasteners. However, when the fasteners are located in a narrow space such as in an engine room, the fasteners are not easily accessed because too many parts are located nearby the fasteners. If the parts nearby the fasteners are to be removed from the engine room, it will take too much time and obviously is not an efficient task.

U.S. Pat. Nos. 6,276,236, 6,370,985 and 7,104,162 disclose devices for unfastening fasteners. The device usually comprises an operation device, a cable unit and a working unit, wherein the cable unit is connected between the operation device and the working unit. The cable unit includes a cable and a sheath. The operation device pulls the cable relative to the sheath, and the cable drives the working unit.

The devices disclosed by the above mentioned documents can unfasten or remove the fasteners in a narrow space.

The present invention intends to provide a device for unfastening pipe fasteners, and the operation device is easily connected to or separated from the cable unit, so that the device can replace the operation devices of different functions to meet different needs.

SUMMARY OF THE INVENTION

The primary object of the present invention is to provide a device for unfastening pipe fasteners wherein the cable unit is easily connected to and separated from the operation device.

To achieve the object of the present invention, the present invention relates a device for unfastening fasteners, comprising: an operation device, a cable unit and a working unit, the cable unit connected between the operation device and the working unit, the operation device having a first part, a second part and a pivot, the first and second parts being pivotably connected to each other at two respective middle portions thereof by the pivot, the first part including a first handle and a first extension respectively formed on two ends thereof, the second part including a second handle and a second extension respectively formed on two ends thereof, the first extension including a first hole, the second extension having a second hole; the cable unit having a cable and a sheath through which the cable extends, a first end of the cable extending beyond a first end of the sheath and connected to the operation device, a second end of the cable extending beyond a second end of the sheath and connected to the working unit, the first end of the cable extending through the second hole and the first hole and connected to an end piece which contacts against the first extension, the sheath has a first end thereof connected with an insertion which includes a first segment and a second segment which is axially connected to the first segment, the first segment contacting the second extension, the second segment extending through the second hole and secured by a positioning member; wherein, the first extension includes a first slot which communicates with the first hole, the second extension includes a second slot which communicates with the second hole, the cable passes through the first hole via the first slot, the cable passes through the second hole via the second slot, a width of the second slot is smaller than an outer diameter of the second segment, the operation device includes a stop member which is mounted to the first extension to stop the cable from disengaging from the first hole via the first slot.

Preferably, the stop member includes a first side portion, a second side portion and a first connection portion, a room is defined in the stop member and receives a portion of the first extension, the first side portion faces the second side portion, the first connection portion is connected between the first and second side portions, the first side portion includes a first notch and a first recess defined in an inside thereof, the second side portion includes a second notch and a second recess defined in an inside thereof, the first notch is located corresponding to the second notch, the first recess is located corresponding to the second notch, the first and second notches communicate with a front side of the room, the first and second recesses communicate with a rear side of the room, the cable enters into the room via the first and second notches, the end piece enters into the first and second recesses and contacts against the first extension, a first transverse portion extends laterally from the first side portion and includes a first engaging portion on a distal end thereof which extends toward and contacts outside of the second side portion so as to connect the first and second side portions.

Preferably, the stop member includes a board and a flange extending along a portion of a periphery of the board, the board has an aperture defined therethrough, the board is mounted to the first extension, the end piece extends through the aperture and contacts outside of the board, the flange is mounted to a top and two sides of the first extension and closes first slot at the top of the first extension, the board has two arms extending therefrom which position the board therebetween, each arm has a hooked end which hooks an inside of the first extension to secure the first extension to the stop member.

Preferably, the flange has a tongue extending therefrom which is engaged with the first slot to prevent the cable from disengaging from the first hole via the first slot.

Preferably, the second extension has a housing mounted thereto, the housing includes a space in which a portion of the second extension is accommodated.

Preferably, the housing includes a first portion, a second portion and a second connection portion, the first and second portions face each other, the second connection portion is connected between the first and second portions, the first side portion includes a third notch and a third recess defined in an inside thereof, the second portion includes a fourth notch and a fourth recess defined in an inside thereof, the third notch is located corresponding to the fourth notch, the third recess is located corresponding to the fourth recess, the third and fourth notches communicate with a front side of the space, the third and fourth recesses communicate with a rear side of the space, the first segment enters into the space via the third and fourth recesses, and contacts the second extension, the cable extends through the third and fourth recesses, and extends beyond the space, a second transverse portion extends laterally from the second portion and includes a second engaging portion on a distal end thereof which extends toward and contacts outside of the first portion so as to connect the first and second portions.

Preferably, the housing includes an outlet, the positioning member formed by bending a metal wire, a top of the positioning member extends through the outlet, the positioning member includes a first section, a second section, a third section, and a fourth section, a first section, the first section is located to face the second section, the first section and the second section are integrally formed with each other at two respective top thereof, two respective lower ends of the first section and the second section are located close to each other, the third section extends from the lower end of the first section at an angle, the fourth section extends from the lower end of the second section at an angle, a distance between the third and fourth sections increases in a direction toward two respective distal ends of the third and fourth sections, a clamp area is formed between the first and second sections, when the second segment enters into the clamp area, the second segment is clamped by the first and second sections.

Preferably, the positioning member is formed by bending a metal wire, a top of the positioning member extends through the outlet, the positioning member includes a first section, a second section, a third section, and a fourth section, the first section is located to face the second section, the first section and the second section are integrally formed with each other at two respective top thereof, two respective lower ends of the first section and the second section are located close to each other, the third section extends from the lower end of the first section at an angle, the fourth section extends from the lower end of the second section at an angle, a distance between the third and fourth sections increases in a direction toward two respective distal ends of the third and fourth sections, a clamp area is formed between the first and second sections, when the second segment enters into the clamp area, the second segment is clamped by the first and second sections.

Preferably, the positioning member is a C-clip.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
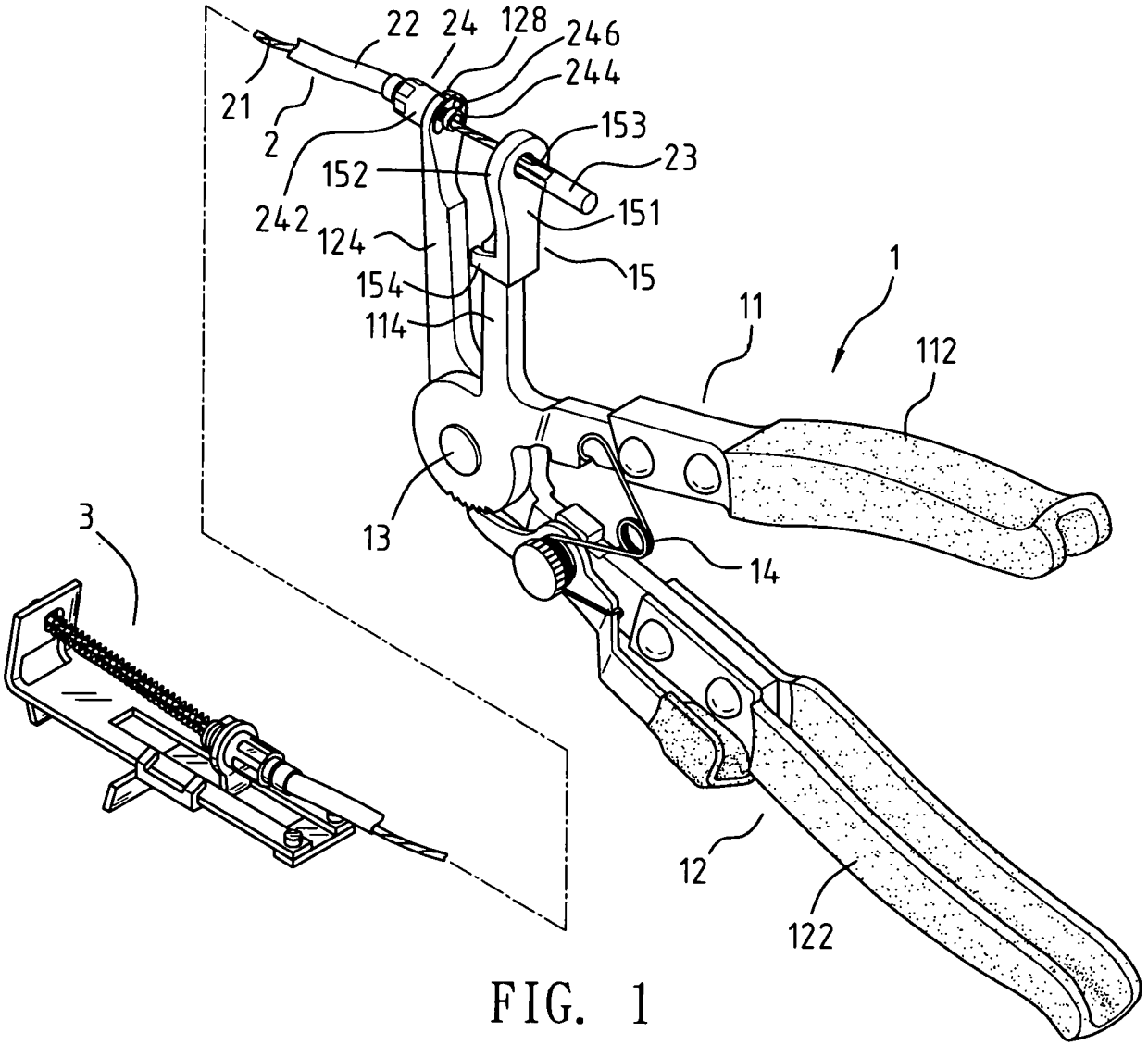
FIG. 1 shows the device for unfastening pipe fasteners of the present invention.
Figure 2:
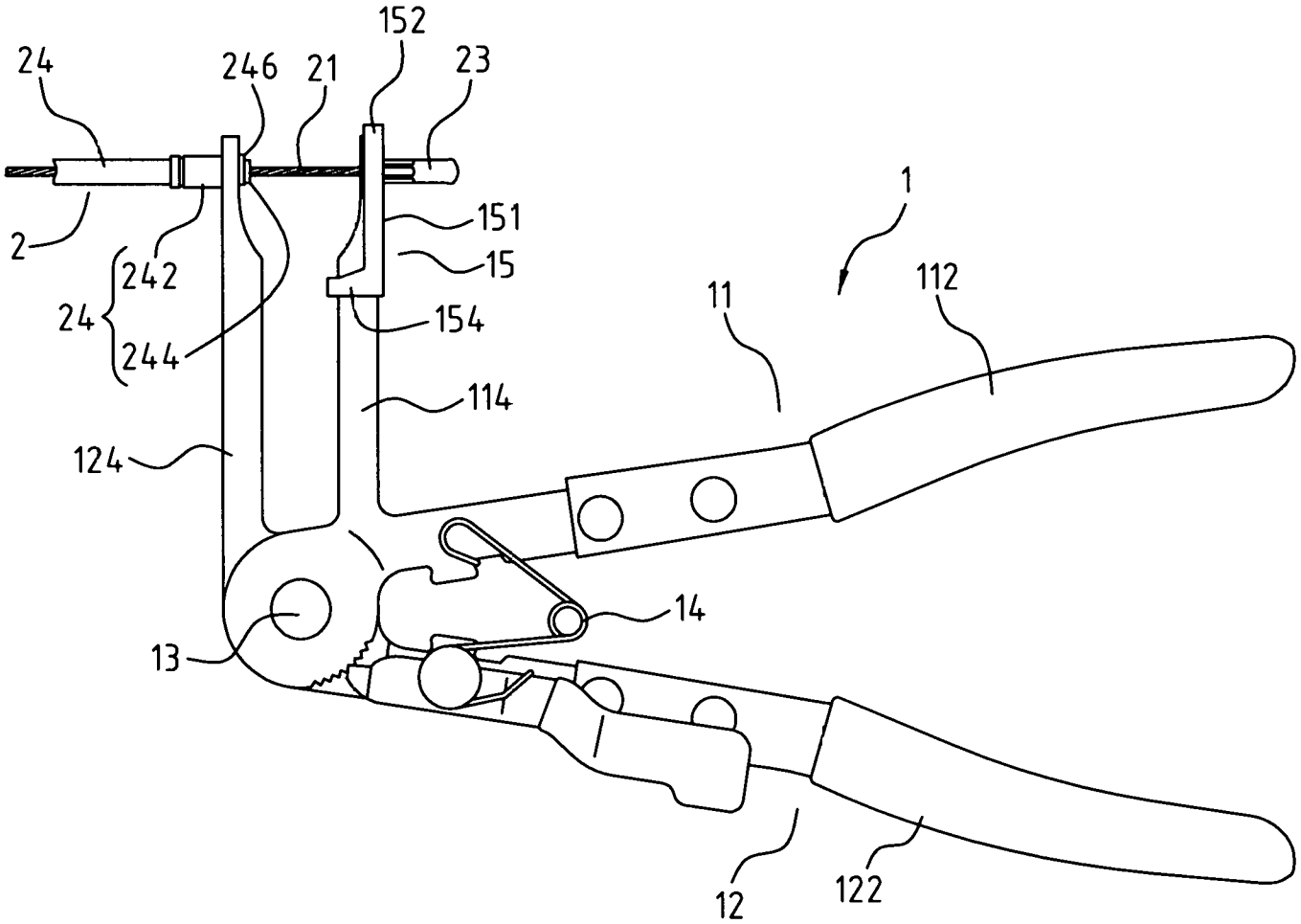
FIG. 2 shows a side view of the device for unfastening pipe fasteners of the present invention.
Figure 3:
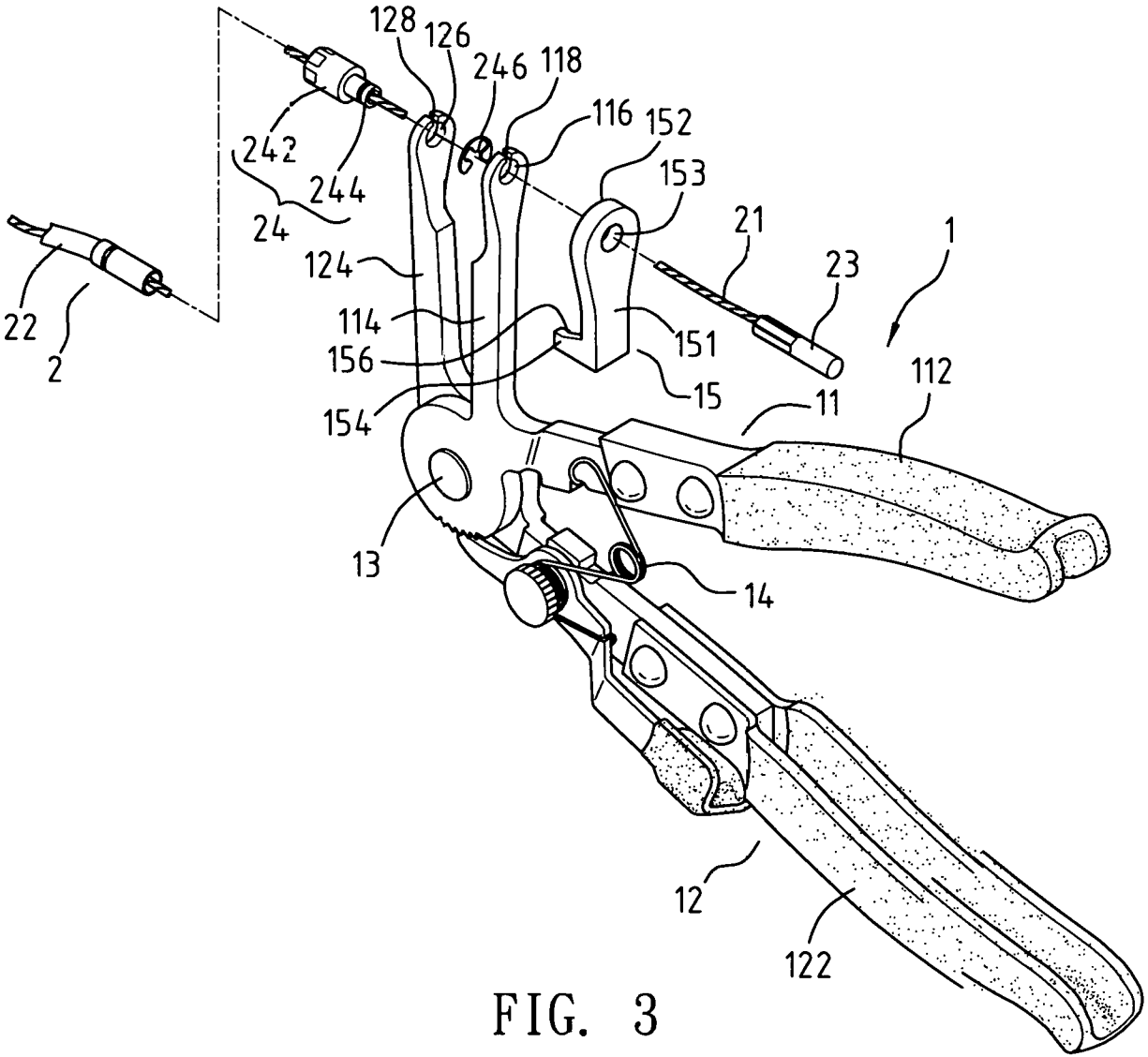
FIG. 3 is an exploded view of the device for unfastening pipe fasteners of the present invention.
Figure 4:
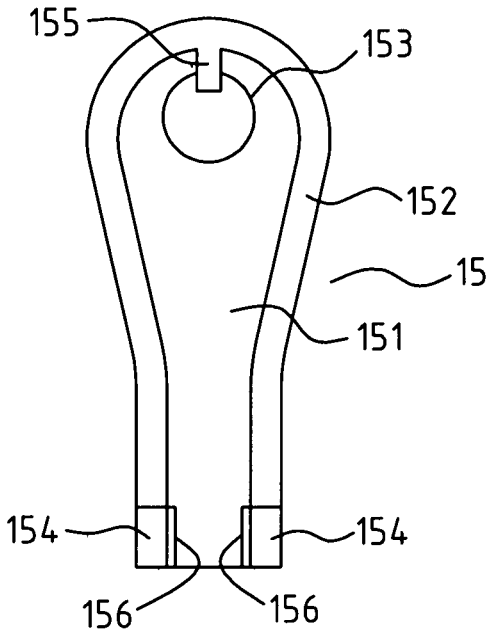
FIG. 4 is the front view of the first embodiment of the stop member of the device for unfastening pipe fasteners of the present invention.
Figure 5:
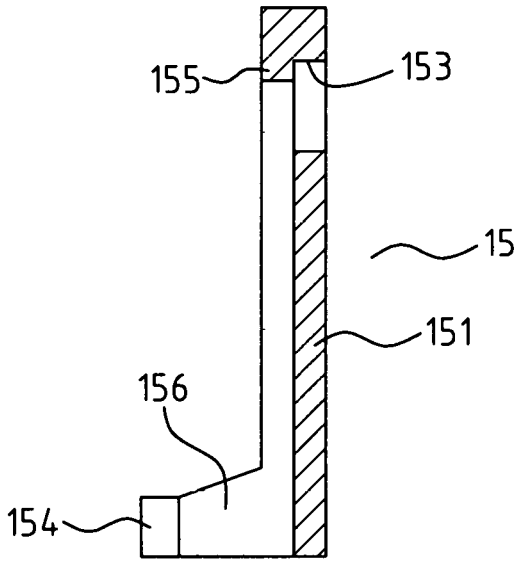
FIG. 5 is a side cross sectional view of the first embodiment of the stop member of the device for unfastening pipe fasteners of the present invention.
Figure 6:
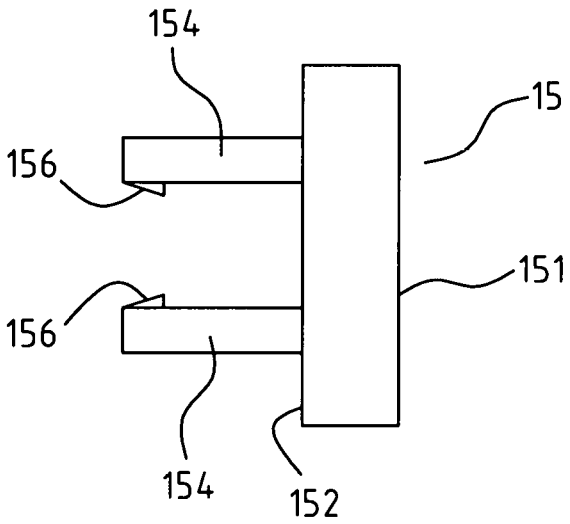
FIG. 6 is an end view of the first embodiment of the stop member of the device for unfastening pipe fasteners of the present invention.

Referring to FIGS. 1 to 3, the device for unfastening pipe fasteners of the present invention comprises an operation device 1, a cable unit 2 and a working unit 3. The cable unit 2 is connected between the operation device 1 and the working unit 3. The operation device 1 controls the working unit 3 by the cable unit 2.

The operation device 1 comprises a first part 11, a second part 12 and a pivot 13. The first and second parts 11, 12 are pivotably connected to each other at two respective middle portions thereof by the pivot 13. The first and second parts 11, 12 are pivotable about the pivot 13. A torsion spring 14 is connected between the first and second parts 11, 12 so that when the users release the first and second parts 11, 12, the torsion spring 14 biases the first and second parts 11, 12 back to their initial positions. The first part 11 includes a first handle 112 and a first extension 114 respectively formed on two ends thereof, and the second part 12 includes a second handle 122 and a second extension 124 respectively formed on two ends thereof. The first extension 114 has a first hole 116, and the second extension 124 has a second hole 126. When the first and second handles 112, 122 are pivoted toward each other, the first and second extensions 114, 124 are moved away from each other.

The cable unit 2 includes a cable 21 and a sheath 22 through which the cable 21 extends. The first end of the cable 21 extends beyond the first end of the sheath 22 and is connected to the operation device 1. The second end of the cable 21 extends beyond a second end of the sheath 22 and is connected to the working unit 3. The first end of the cable 21 extends through the second hole 126 and the first hole 116, and is connected to an end piece 23 which contacts against the first extension 114. The sheath 22 has the first end thereof connected with an insertion 24 which includes a first segment 242 and a second segment 244 which is axially connected to the first segment 232. The first segment 242 is connected to the sheath 22. The second segment 244 extends through the second hole 126. The outer diameter of the first segment 242 is larger than an inner diameter of the second hole 126, so that the first segment 242 contacts the second extension 124. The second segment 244 extends through the second hole 126 and is secured by a positioning member 246 which is a C-clip. Therefore the insertion 24 is pivotably connected to the second extension 124.

When operating the first handle 112 and the second handle 122 to allow the second extension 124 and the first extension 114 to pivot about the pivot 13 in opposite directions, the operation device 1 controls the cable 21 to slide relative to the sheath 22, and the operation device 1 controls the operation of the working unit 3 by the cable unit 2. The working unit 3 is a well known unit and will not be described in detail.

The first extension 114 includes a first slot 118 which communicates with the first hole 116, and the second extension 124 includes a second slot 128 which communicates with the second hole 126. A width of each of the first and second slots 118, 128 is slightly larger than the outer diameter of the cable 21. The cable 21 passes through the first hole 116 via the first slot 118, and the cable 21 passes through the second hole 126 via the second slot 128. Therefore, the operation device 1 can be separated from the cable unit 2 by shifting the cable 21 relative to the first and second slots 118, 128. The width of the second slot 128 is smaller than the outer diameter of the second segment 244, so that the second segment 244 cannot enter into the second slot 128 from the second hole 126, and the connection between the insertion 24 and the second extension 124 is secured.

The operation device 1 includes a stop member 15 which is mounted to the first extension 114 to stop the cable 21 from disengaging from the first hole 116 via the first slot 118. Preferably, the stop member 15 is made of resilient material.

As shown in FIGS. 3 to 6, the stop member 15 includes a board 151 and a flange 152 extending along a portion of the periphery of the board 151. In other words, the flange 152 does not close a lower end of the board 151. The board 151 has an aperture 153 defined therethrough, and the inner diameter of the aperture 153 is larger than the outer diameter of the end piece 23. The board 151 is mounted to the first extension 114, and the end piece 23 extends through the aperture 153 and contacts outside of the board 51. The flange 152 is mounted to the top and two sides of the first extension 114 and closes the first slot 118 at the top of the first extension 114. The cable 21 cannot disengaged from the first slot 118 by the stop member 15. The flange 152 has a tongue 155 extending therefrom which is engaged with the first slot 118 to prevent the cable 21 from disengaging from the first hole 116 via the first slot 118. The board 151 has two arms 154 extending therefrom which position the board 151 therebetween. Each arm 154 has a hooked end 156 which hooks the inside of the first extension 114 to secure the first extension 114 to the stop member 15.

When separating the cable unit 2 from the operation device 1, the stop member 15 is pulled away from the first extension 114 and the two arms 154 are expanded outward and the hooked ends 156 are disengaged from the first extension 114, so that the stop member 15 are separated from the first extension 114. The cable 21 is then pulled to pass through the first slot 118 and separated from the first extension 114. The positioning member 246 is separated from the second segment 244 so that the second segment 244 slides away from the second extension 124. The cable 21 then passes through the second slot 128 and is separated from the second extension 124. The cable unit 2 is successfully separated from the operation device 1.

The sequence of steps for separating the cable unit 2 from the operation device 1 can be varied. The positioning member 246 can be first removed and then the stop member 15 is removed to separate the cable 21 from the first and second extensions 114, 124.

When connecting the cable unit 2 to the operation device 1, the stop member 15 is not yet connected to the first extension 114. The cable 21 passes through the first and second slots 118, 128 to enter into first and second holes 116, 126. The end piece 23 contacts the first extension 114. The second segment 244 enters into the second hole 126, and the positioning member 246 is mounted to the second segment 244 to position the insertion 24 to the second extension 124. The stop member 15 is then mounted to the first extension 114 to complete the connection between the cable unit 2 and the operation device 1.

The cable unit 2 is easily separated from the operation device 1 without damaging the cable unit 2. The cable unit 2 and the working unit 3 can be replaced when the working unit 3 needs to be replaced. The different working units 3 are optionally replaced and chosen by separation/connection between the operation device 1 and the cable unit 2 so as to deal with different types of work.

Figure 7:
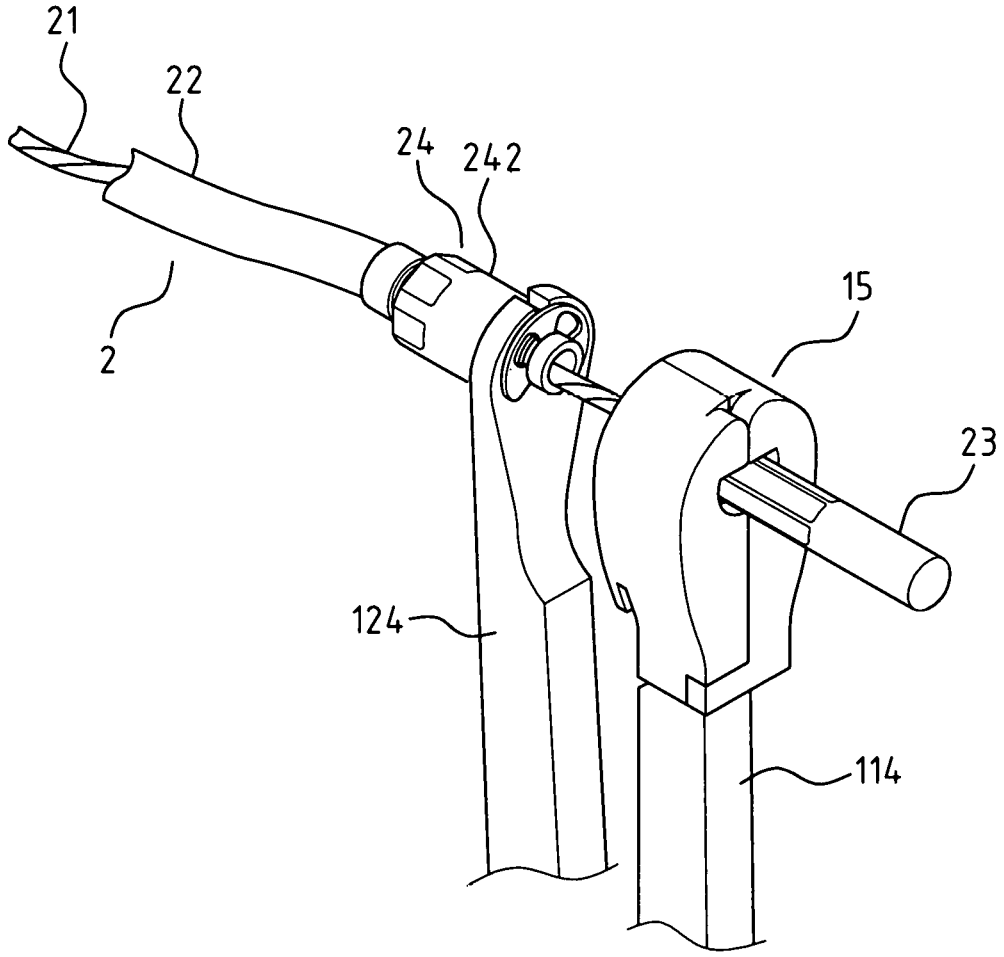
FIG. 7 shows the second embodiment of the stop member and the cable unit of the device for unfastening pipe fasteners of the present invention.
Figure 8:
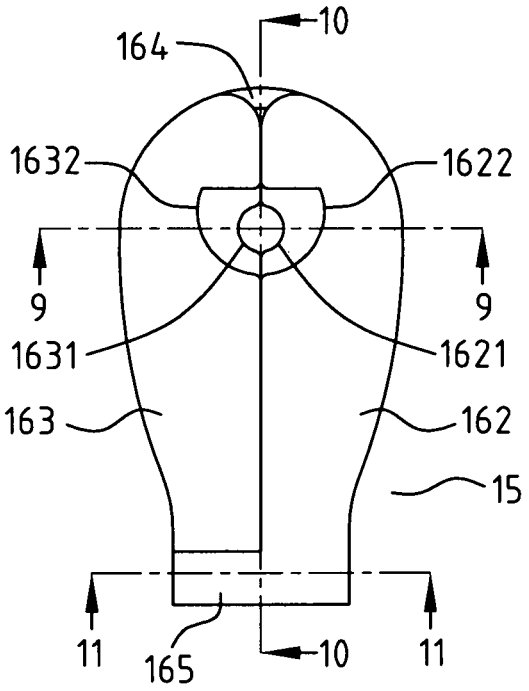
FIG. 8 shows the rear end view of the second embodiment of the stop member of the device for unfastening pipe fasteners of the present invention.
Figure 9:
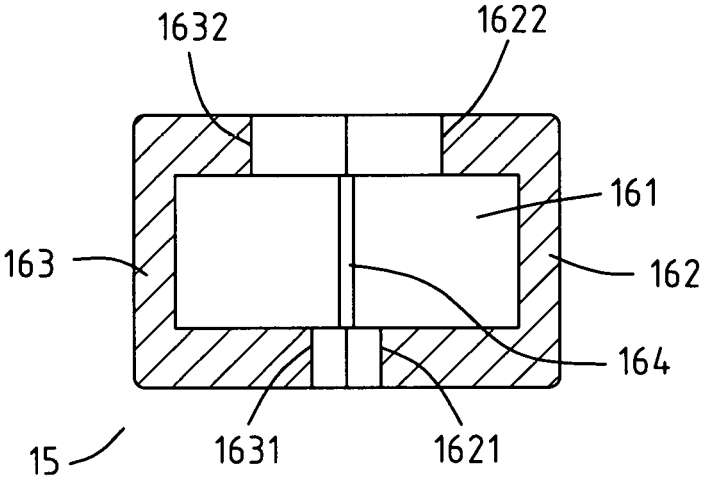
FIG. 9 is a cross sectional view, taken along line 9-9 in FIG. 9.
Figure 10:
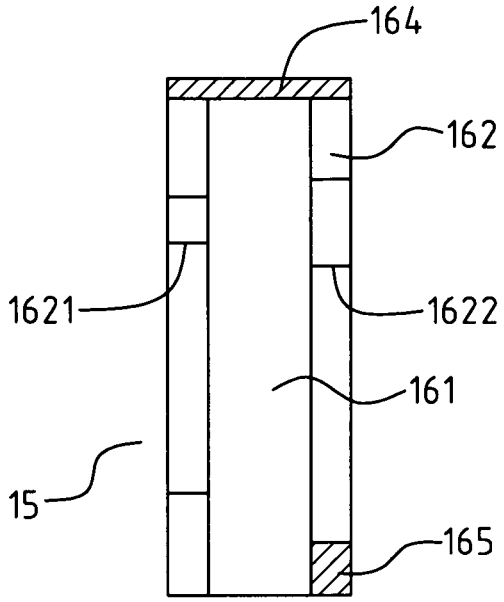
FIG. 10 is a cross sectional view, taken along line 10-10 in FIG. 8.
Figure 11:
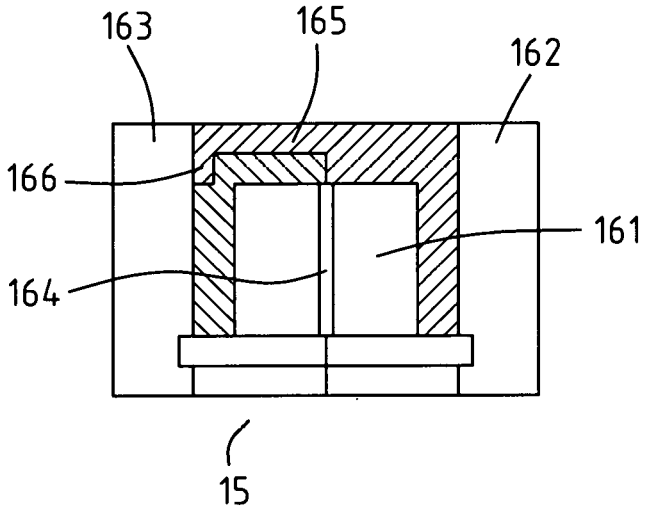
FIG. 11 is a cross sectional view, taken along line 11-11 in FIG. 8.

FIG. 7 shows the second embodiment and comprises an operation device 1, a cable unit 3 and a working unit (not shown). The stop member 15 is mounted to the first extension 114 of the operation device 1.

As shown in FIGS. 7 to 11, the stop member 15 includes a first side portion 162, a second side portion 163 and a first connection portion 164. A room 161 is defined in the stop member 15 and receives a portion of the first extension 114. The first side portion 162 faces the second side portion 163, and the first connection portion 164 is connected between the first and second side portions 162, 163. The first side portion 162 includes a first notch 1621 and a first recess 1622 defined in the inside thereof, and the second side portion 163 includes a second notch 1631 and a second recess 1632 defined in the inside thereof. The first notch 1621 is located corresponding to the second notch 1631, and the first recess 1622 is located corresponding to the second notch 1632. The first and second notches 1621, 1631 communicate with the front side of the room 161. The first and second recesses 1622, 1632 communicate with the rear side of the room 161. The cable 21 enters into the room 161 via the first and second notches 1621, 1631. The end piece 23 enters into the first and second recesses 1622, 1632 and contacts against the first extension 114. A first transverse portion 165 extends laterally from the first side portion 162 and includes a first engaging portion 166 on the distal end thereof which extends toward and contacts outside of the second side portion 163 so as to connect the first and second side portions 162, 163.

When separating the cable unit 2 from the operation device 1, the first engaging portion 166 is disengaged from the second side portion 163. The first and second side portions 162, 163 are pivoted outward to move the stop member 15 upward so as to separate the stop member 15 from the first extension 114, and the cable 21 can be separated from the first extension 114. The positioning member 246 is then separated from the second segment 244, and the second segment 244 is slid to separate from the second extension 124. The cable 21 then passes through the second slot 128 and is separated from the second extension 124 to successfully separate the cable unit 2 from the operation device 1.

The sequence of steps for separating the cable unit 2 from the operation device 1 can be varied. The positioning member 246 can be first removed and then the stop member 15 is removed to separate the cable 21 from the first and second extensions 114, 124.

When connecting the cable unit 2 to the operation device 1, the stop member 15 is not yet connected to the first extension 114. The cable 21 extends through the first and second extensions 114, 124. The end piece 23 contacts the first extension 114. The insertion 24 is positioned to the second extension 124. The stop member 15 is then mounted to the first extension 114 to complete the connection between the cable unit 2 and the operation device 1.

Figure 12:
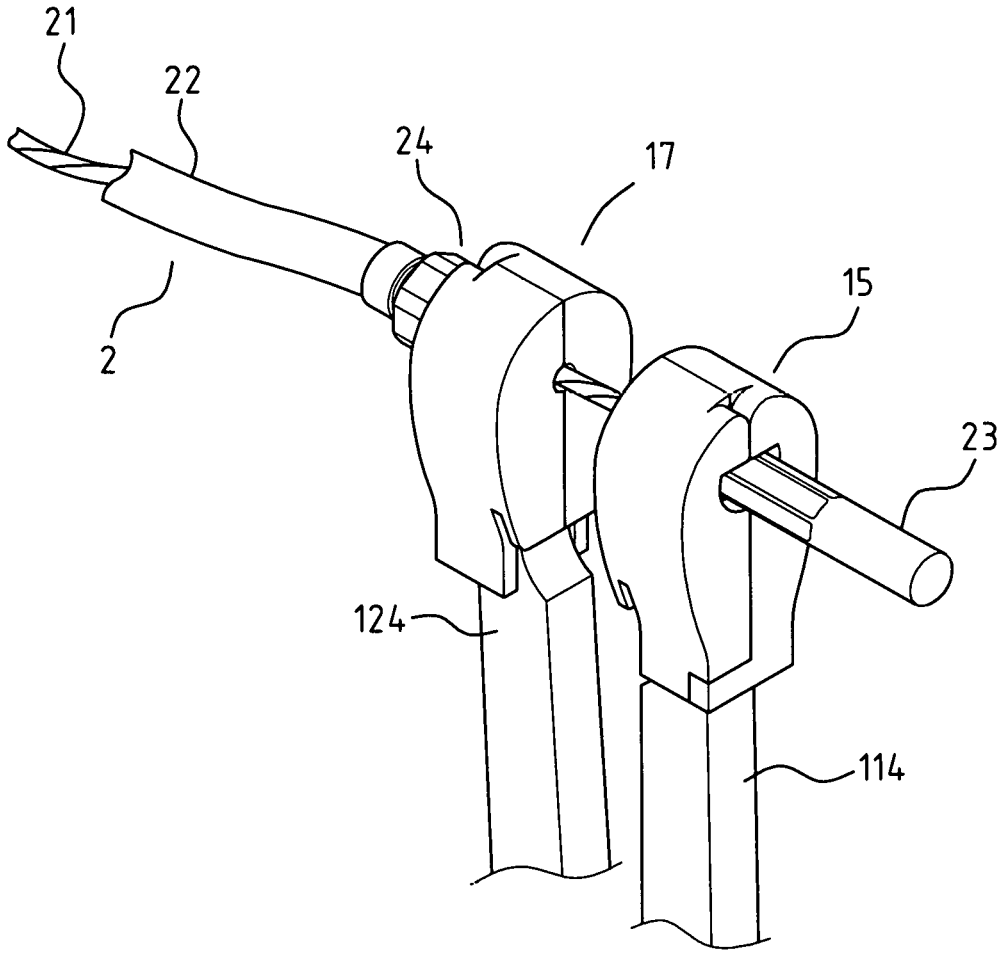
FIG. 12 shows the third embodiment of the operation device and the cable unit.
Figure 13:
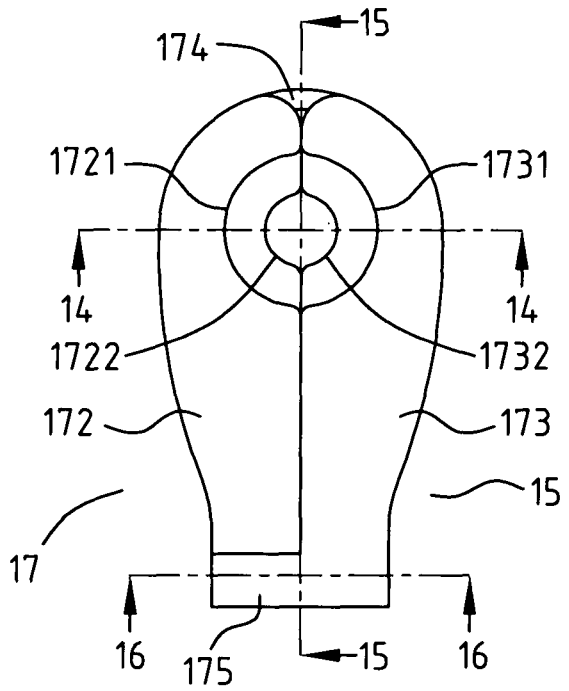
FIG. 13 shows the third embodiment of the stop member of the present invention.
Figure 14:
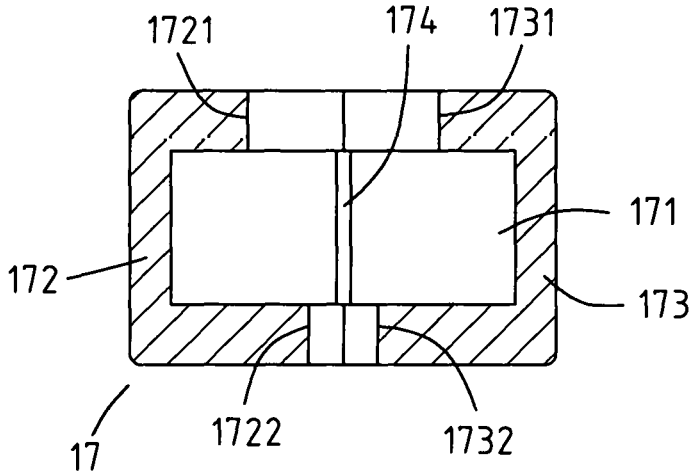
FIG. 14 is a cross sectional view, taken along line 14-14 in FIG. 13.
Figure 15:
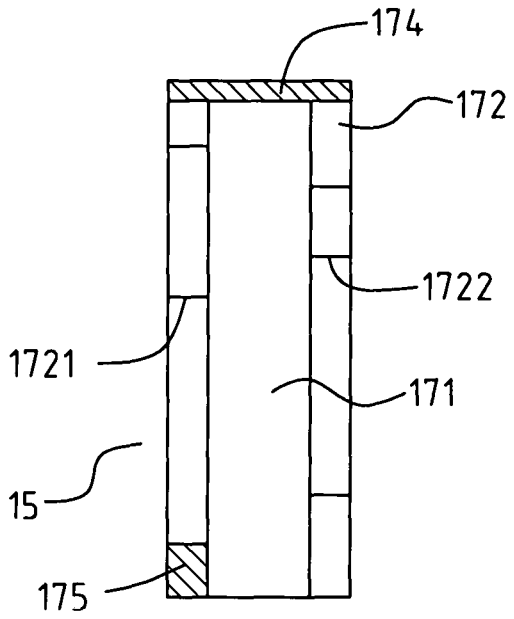
FIG. 15 is a cross sectional view, taken along line 15-15 in FIG. 13.
Figure 16:
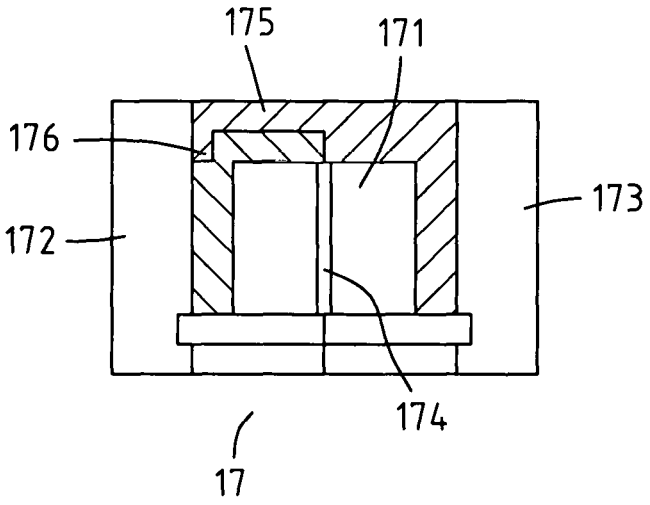
FIG. 16 is a cross sectional view, taken along line 16-16 in FIG. 13.

FIG. 12 shows the third embodiment, and comprises an operation device 1, a cable unit 2 and a working unit (not shown), wherein the operation device 1 further includes a housing 17 mounted to the second extension 124 of the operation device 1.

As shown in FIGS. 13 to 16, the housing 17 includes a space 171 in which a portion of the second extension 124 is accommodated. The housing 17 includes a first portion 172, a second portion 173 and a second connection portion 174. The first and second portions 172, 173 face each other, and the second connection portion 174 is connected between the first and second portions 172, 173. The first side portion 162 includes a third notch 1721 and a third recess 1722 defined in the inside thereof, and the second portion 173 includes a fourth notch 1731 and a fourth recess 1732 defined in the inside thereof. The third notch 1721 is located corresponding to the fourth notch 1731, and the third recess 1722 is located corresponding to the fourth recess 1732. The third and fourth notches 1721, 1731 communicate with the front side of the space 171. The third and fourth recesses 1722, 1732 communicate with the rear side of the space 171. The first segment 242 enters into the space 171 via the third and fourth recesses 1722, 1732, and contacts the second extension 124. The cable 21 extends through the third and fourth recesses 1722, 1732, and extends beyond the space 171. A second transverse portion 175 extends laterally from the second portion 173 and includes a second engaging portion 176 on the distal end thereof which extends toward and contacts outside of the first portion 172 so as to connect the first and second portions 172, 173.

When separating the housing 17 from the first extension 114, the second engaging portion 176 is disengaged from the second portion 173. The first and second portions 172, 173 are pivoted outward to move the stop member 15 upward so as to separate the stop member 15 from the first extension 114.

Figure 17:
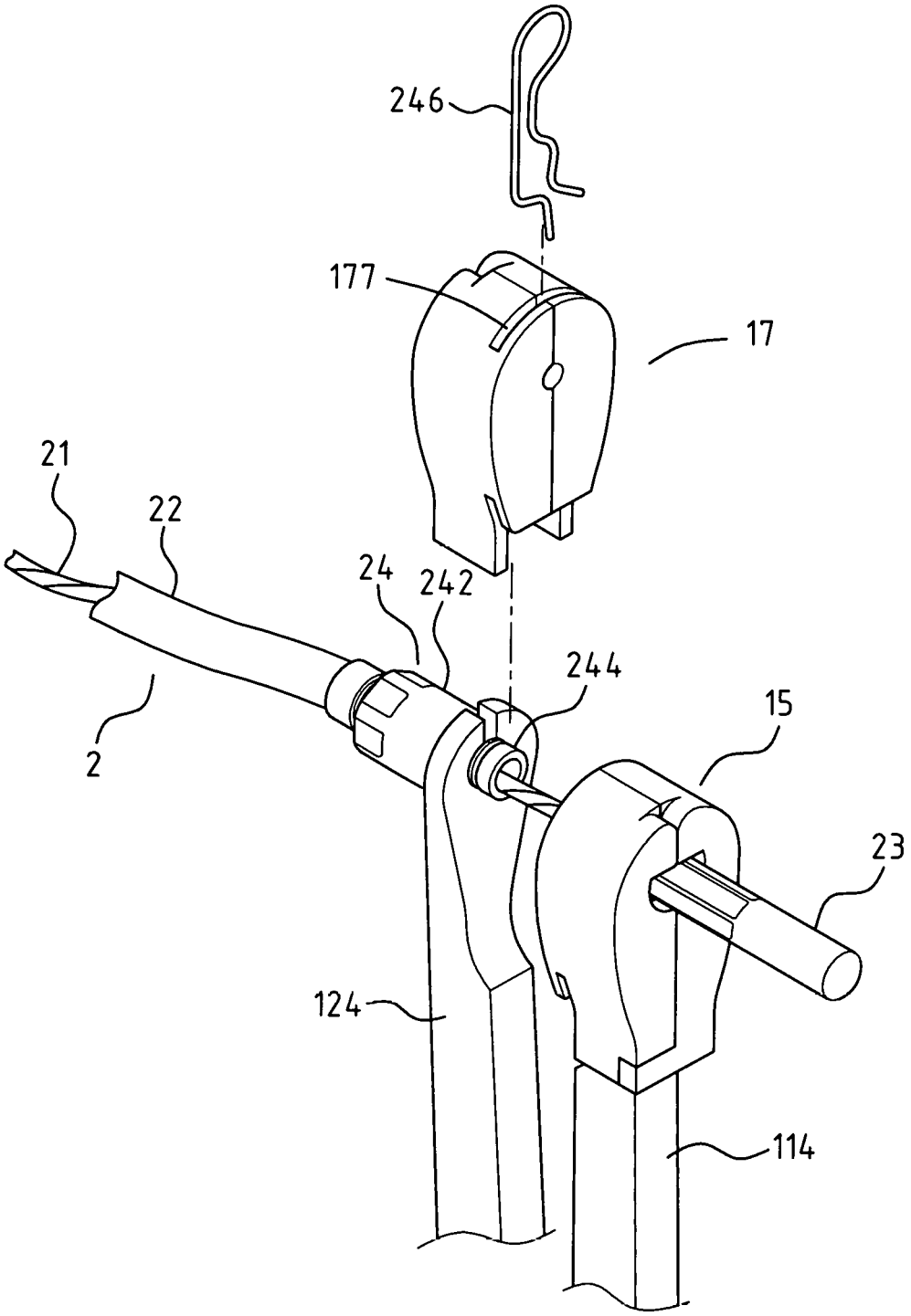
FIG. 17 shows that the fourth embodiment of the operation device, the positioning member and the stop member of the present invention.

As shown in FIG. 17 which shows the fourth embodiment of the present invention, and comprises an operation device 1, a cable unit 2 and a working unit (not shown), wherein the sheath 22 is connected to the insertion 24 of the operation device 1. The insertion 24 includes a first segment 242 and a second segment 244. The first segment 242 extends through the second extension 124 of the operation device 1 and a positioning member 246 is mounted to the first segment 242. A housing 17 is mounted to the first segment 124.

Figure 18:
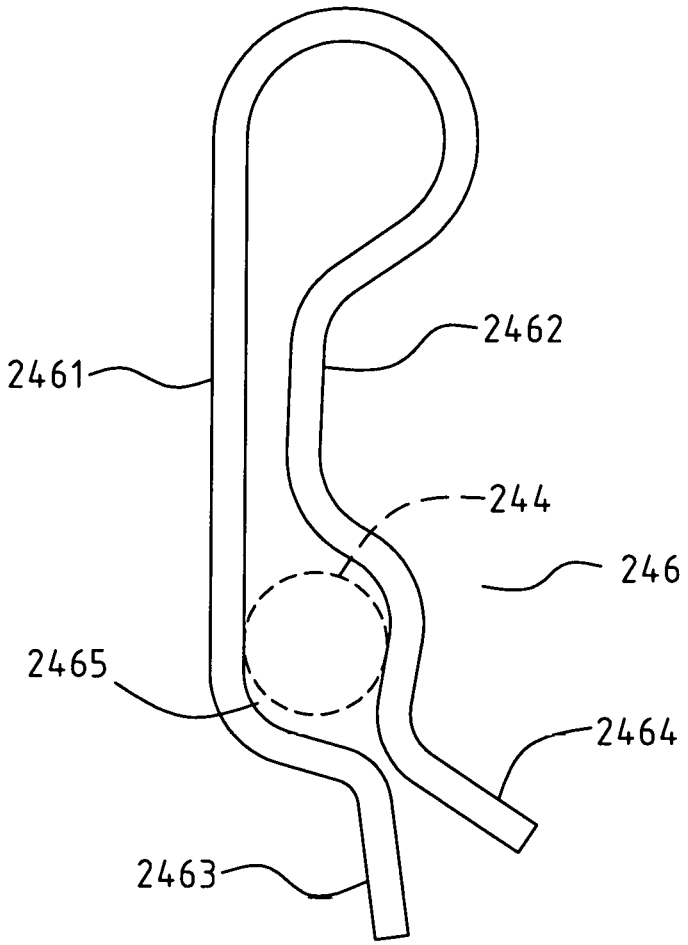
FIG. 18 is a front view of the fourth embodiment of the positioning member of the present invention.

As shown in FIGS. 17 and 18, the positioning member 246 is formed by bending a metal wire. The top of the positioning member 246 extends through an outlet 177 defined through the top of the housing 17. The positioning member 246 includes a first section 2461, a second section 2462, a third section 2463, and a fourth section 2464. The first section 2461 is located to face the second section 2462, and the first section 2461 and the second section 2462 are integrally formed with each other at two respective top thereof. Two respective lower ends of the first section 2461 and the second section 2462 are located close to each other. The third section 2463 extends from the lower end of the first section 2461 at an angle, and the fourth section 2464 extends from the lower end of the second section 2462 at an angle. The distance between the third and fourth sections 2463, 2464 increases in a direction toward two respective distal ends of the third and fourth sections 2463, 2464. A clamp area 2465 is formed between the first and second sections 2461, 2462. When the second segment 244 enters into the clamp area 2465, the second segment 244 is clamped by the first and second sections 2461, 2462.

When the positioning member 246 is mounted to the second segment 244, the user holds the top of the positioning member 246 to move the lower end of the positioning member 246 close to the second segment 244, and to contact the third and fourth sections 2463, 2464 with the two sides of the second segment 244. By the flexibility of the positioning member 246, the second segment 244 enters into the clamp area 244 and is clamped between the first and second sections 2461, 2462 so that the segment 24 is secured by the positioning member 246.

The housing 17 is an optional part in the third and fourth embodiments.

Figure 19:
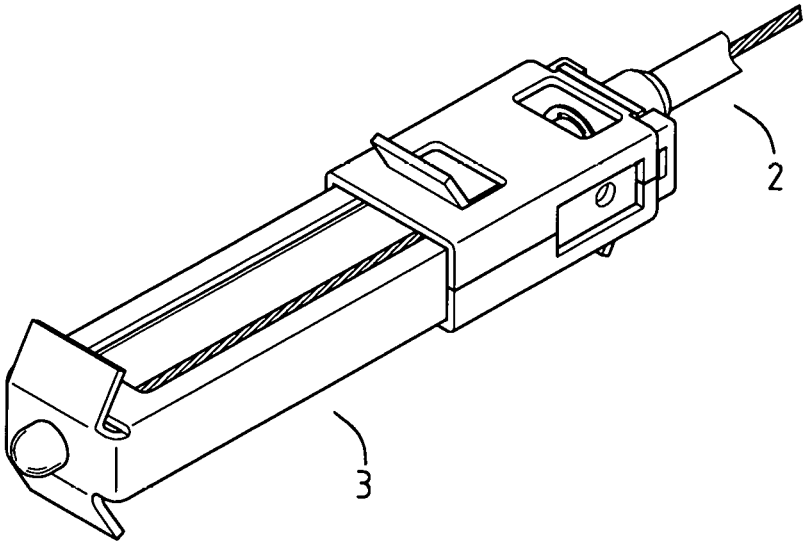
FIGS. 19 to 21 show different options of the working units of the present invention.
Figure 20:
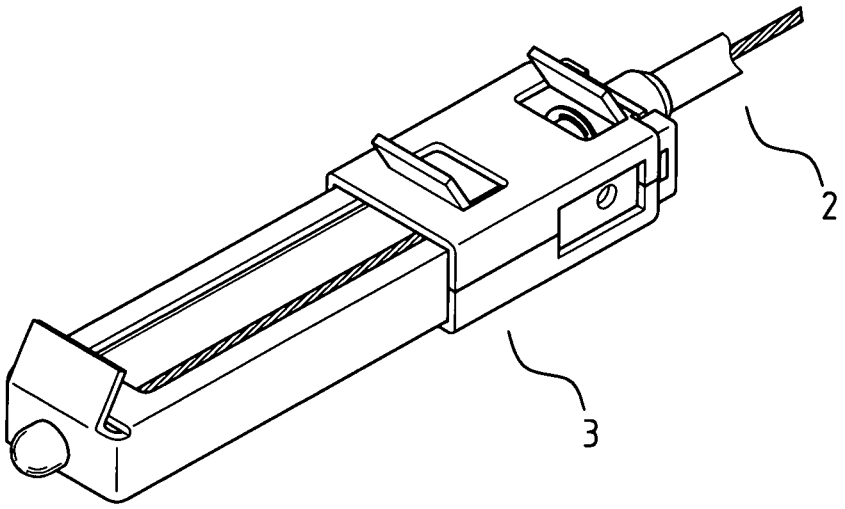
Figure 21:
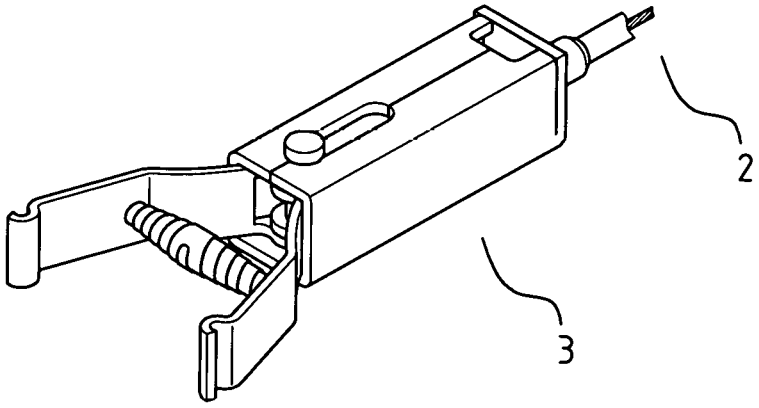

FIGS. 19, 20 and 21 respectively show the different working units 3 according to practical needs.

While the applicant shown and described the embodiments in accordance with the present invention, it should be clear to those skilled in the art that further embodiments may be made without departing from the scope of the present invention.

What is claimed is:

1. A device for unfastening fasteners, comprising:

an operation device, a cable unit and a working unit, the cable unit connected between the operation device and the working unit, the operation device having a first part, a second part and a pivot, the first and second parts being pivotably connected to each other at two respective middle portions thereof by the pivot, the first part including a first handle and a first extension respectively formed on two ends thereof, the second part including a second handle and a second extension respectively formed on two ends thereof, the first extension including a first hole, the second extension having a second hole;

the cable unit having a cable and a sheath through which the cable extends, a first end of the cable extending beyond a first end of the sheath and connected to the operation device, a second end of the cable extending beyond a second end of the sheath and connected to the working unit, the first end of the cable extending through the second hole and the first hole and connected to an end piece which contacts against the first extension, the first end of the sheath is connected with an insertion which includes a first segment and a second segment which is axially connected to the first segment, the first segment contacting the second extension, the second segment extending through the second hole and secured by a positioning member;

wherein, the first extension includes a first slot which communicates with the first hole, the second extension includes a second slot which communicates with the second hole, the cable passes through the first hole via the first slot, the cable passes through the second hole via the second slot, a width of the second slot is smaller than an outer diameter of the second segment, the operation device includes a stop member which is mounted to the first extension to stop the cable from disengaging from the first hole via the first slot; and wherein the stop member includes a first side portion, a second side portion and a first connection portion, a room is defined in the stop member and receives a portion of the first extension, the first side portion faces the second side portion, the first connection portion is connected between the first and second side portions, the first side portion includes a first notch and a first recess defined in an inside thereof, the second side portion includes a second notch and a second recess defined in an inside thereof, the first notch is located corresponding to the second notch, the first recess is located corresponding to the second recess, the first and second notches communicate with a front side of the room, the first and second recesses communicate with a rear side of the room, the cable enters into the room via the first and second notches, the end piece enters into the first and second recesses and contacts against the first extension, a first transverse portion extends laterally from the first side portion and includes a first engaging portion on a distal end thereof which extends toward and contacts outside of the second side portion so as to connect the first and second side portions.

2. The device for unfastening fasteners as claimed in claim 1, wherein the stop member including a flange which has a tongue extending therefrom which is engaged with the first slot to prevent the cable from disengaging from the first hole via the first slot.

3. The device for unfastening fasteners as claimed in claim 1, wherein the positioning member is formed by bending a metal wire, a top of the positioning member extends through an outlet, the positioning member includes a first section, a second section, a third section, and a fourth section, the first section is located to face the second section, the first section and the second section are integrally formed with each other at two respective top thereof, two respective lower ends of the first section and the second section are located close to each other, the third section extends from the lower end of the first section at an angle, the fourth section extends from the lower end of the second section at an angle, a distance between the third and fourth sections increases in a direction toward two respective distal ends of the third and fourth sections, a clamp area is formed between the first and second sections, when the second segment enters into the clamp area, the second segment is clamped by the first and second sections.

4. The device for unfastening fasteners as claimed in claim 1, wherein the positioning member is a C-clip.

* * * * *